US005092559A

United States Patent [19]

Tjelle

[11] Patent Number: 5,092,559

[45] Date of Patent: Mar. 3, 1992

[54] CONCRETE FORM SUPPORT ASSEMBLY

[76] Inventor: Leo Tjelle, Rte. 1, Box 159, Braceville, Ill. 60407

[21] Appl. No.: 524,622

[22] Filed: May 17, 1990

[51] Int. Cl.[5] ..... E01D 21/02; E04G 17/18

[52] U.S. Cl. ..... 249/211; 249/24; 249/219.1

[58] Field of Search ..... 249/19, 23–25, 249/211, 219.1

[56] References Cited

U.S. PATENT DOCUMENTS

| | | | |
|---|---|---|---|
| 2,215,972 | 9/1940 | Mueller et al. | 249/211 |
| 2,431,480 | 11/1947 | Hornsby | 411/976 |
| 3,626,648 | 12/1971 | Beckham | 249/23 |
| 3,806,074 | 4/1974 | Ward | 249/24 |
| 3,989,219 | 11/1976 | Pruett | 249/24 |
| 4,660,800 | 4/1987 | Horstketter | 249/24 |

FOREIGN PATENT DOCUMENTS

| | | | |
|---|---|---|---|
| 712509 | 7/1954 | United Kingdom | 249/24 |

*Primary Examiner*—James C. Housel
*Attorney, Agent, or Firm*—Ernest Kettelson

[57] ABSTRACT

A concrete form support assembly for the form structure needed to pour concrete for bridge floors and the like. Such form structures include a plywood flooring supported at a desired uniform depth relative to the plane of the upper surface of the bridge beams, depending on the thickness of the concrete called for by the specifications. The plywood flooring is supported by ledgers which extend laterally between the bridge beams and stringers on the top thereof which extend longitudinally and parallel with the bridge beams. The ledgers are supported by vertical bolts hanging from hanger bars on each side of each bridge beam, with support plates at the lower end of the vertical bolts to support opposite ends of the ledgers, and threaded nuts below the support plates to adjust the plates and ledgers thereon up and down. After the plywood flooring has been put in place, workmen cannot thereafter reach the adjusting nuts from above to make final depth adjustments of the flooring. The support assembly in accordance with the present invention provides depth adjustable hanger bolts adjustable from above the plywood flooring after it has been put in place.

5 Claims, 3 Drawing Sheets

CONCRETE FORM SUPPORT ASSEMBLY

BACKGROUND OF THE INVENTION

This invention relates to the field of supporting assemblies to hold concrete form structures in place to pour concrete floors for bridges and the like, and particularly to the adjustability feature thereof to obtain proper depth for the concrete floor when poured and uniformity of such depth through the entire span of the floor.

The typical form structures for pouring concrete floors for bridges, high rise buildings and the like, comprise ledgers extending laterally between the bridge beams or floor beams, stringers extending longitudinally across and on top of the ledgers, and plywood sheets on top of the stringers to provide the floor on which the concrete is to be poured. The ledgers are supported by hanger bolts hanging down from hanger bars laying laterally across the upper surface of the bridge beams or floor beams, having support plates at the lower ends of the hanger bolts bearing against threaded nuts and with end portions of the ledgers resting on the support plates.

The problem with prior art support assemblies is that the depth of the plywood flooring cannot be adjusted from above after the plywood has been laid on the stringers. In order to reach the threaded nuts at the lower ends of the hanger bolts to rotate and thereby raise or lower each ledger and the portion of plywood flooring supported thereby, it is necessary for workmen to do so from below. However, since the plywood flooring is in place, communication with workmen above who can measure the flooring depth relative to the upper surface of the bridge beams or floor beams is difficult if not a practical impossibility.

If workmen try to reach the adjusting nuts below from above the plywood flooring, such as by removing one panel and trying to reach down below, there is the danger that the workmen will slip and fall, that he will drop his wrench which may hit someone below the bridge, and any adjustment made by this awkward procedure is not likely to be as accurate and precise as if the adjustment can be made from above.

The support assembly in accordance with the present invention solves that problem by providing depth adjustable hanger bolt assemblies which can be adjusted as to depth of the plywood floor of the concrete form from above the plywood flooring after it has been put in place, and such depth can be made uniform throughout the entire surface area of the floor. Furthermore, the hanger bolt assemblies can be utilized after the concrete floor has hardened to lower the form structure enough to be removed from the hardened concrete safely in a piece by piece maneuver while the support assembly is still in place to prevent any individual pieces from falling accidentally and hitting someone below.

Prior art devices in this field known to the inventor include those set forth in the following United States patents.

U.S. Pat. No. 3,989,219 which discloses an elevation gauge to measure depth of concrete to be laid, and a prior art support assembly in which the nut supporting the plate on which the ledger rests is welded to the plate so it cannot be rotated independently of the plate.

Others examined by the inventor in an attempt to determine whether his invention was sufficiently different are:

In Class 411/84:

U.S. Pat. No. 4,830,203; 4,789,286; 4,750,310; 4,722,647; 4,708,554; 4,671,580; 4,661,006; 4,645,393; 4,629,381; 4,600,226; 4,529,244; 4,486,133; 4,239,139; 4,227,722; 4,070,847; 4,021,129; 4,015,390; 3,873,224; 3,846,851; 3,813,179; 3,599,693; 3,483,910; 3,456,706; 3,329,601; 3,322,177; 3,309,119; 3,288,512; 3,186,049; 3,150,703; 3,117,610; 3,037,731; and 2,542,375;

In Class 411/85:

U.S. Pat. No. 4,840,525; 4,830,531; 4,828,440; 4,790,701; 4,784,554; 4,784,552; 4,768,907; 4,758,124; 4,741,582; 4,695,212; 4,666,355; 4,661,030; 4,661,006; 4,630,982; 4,623,182; 4,571,135; 4,545,697; 4,488,844 and 3,446,261;

In Class 411/88:

U.S. Pat. No. 4,836,043; 4,740,124; 4,475,857; 4,329,097; 2,879,092;

In Class 411/90:

U.S. Pat. No. 4,852,700; 4,740,124; 4,562,707; and 3,623,761;

In Class 411/102:

U.S. Pat. No. 4,767,371; 4,329,097; 4,219,386; and 3,351,116;

In Class 411/116:

U.S. Pat. No. 4,789,286; 4,767,371; 4,661,030; 4,637,641; 4,618,272; 4,377,360; 4,341,053; 4,325,178; 4,283,091; 4,263,952; 4,210,372; 4,191,235; 4,183,387; 4,113,227; 4,106,541; 4,074,491; 4,046,481; 4,017,946; 3,890,758; 3,880,535; 3,874,624; 3,825,283; 3,804,140; 3,734,459; 3,694,013; 3,636,241; 3,620,574; 3,606,393; 3,504,723; 3,498,655; 3,493,201; 3,478,802; 3,434,261; 3,424,064; 3,403,605; 3,378,288; 3,377,633; 3,367,383; and 3,357,730;

In Class 411/102:

U.S. Pat. No. 4,767,371; 4,329,097; 4,219,386; 3,351,116; 2,372,772; 1,812,319; 1,448,605; 1,413,976; 1,200,285; 1,039,483; 944,666; 887,382; 870,547; 846,949; 729,966; 594,950; 530,290; 431,705; 365,674; 190,443 and 128,815;

In Class 411/83:

U.S. Pat. No. 4,754,749; 4,613,265; 4,570,303; 4,312,145; 4,283,091; 4,274,460; 4,257,466; 4,257,465; 4,252,167; 4,236,562; 4,185,937; 4,150,618; 4,138,198; 4,124,974; 4,121,700; 4,113,921; 4,113,227; 4,106,541; 4,087,201; 4,061,400; 3,920,338; 3,870,092; 3,863,300; 3,797,548; 3,677,588; 3,511,289; 3,458,132; 3,399,269; 3,393,724; 3,390,500; 3,363,280; 3,329,875; 3,308,587; 3,285,312; 3,218,101; 3,175,795; 3,164,323; 3,111,704; 3,031,220; 3,016,077; 2,955,291; 2,940,712; 2,883,720; 2,842,384; 2,832,390; 2,799,900; 2,795,261; 2,773,620; 2,771,642; 2,768,037; 3,743,143; 2,741,290; 2,737,993; 2,731,791; 2,720,392; 2,692,518; 2,672,659; 2,670,513; 2,651,488; 2,649,126; 2,635,923; 2,634,940; 2,544,387;

In Class 411/84:

U.S. Pat. No. 4,830,203; 4,789,286; 4,750,310; 4,722,647; 4,708,554; 4,671,580; 4,661,006; 4,645,393; 4,629,381; 4,600,226; 4,529,244; 4,486,133; 4,239,139; 4,227,722; 4,070,847; 4,021,129; 4,015,390; 3,873,224; 3,846,851; 3,813,179; 3,599,693; 3,483,910; 3,456,706; 3,429,601; 3,322,177; 3,309,119; 3,288,512; 3,186,049; 3,150,703; 3,117,610; 2,542,375.

SUMMARY OF THE INVENTION

It is an object of the invention to provide a support assembly for supporting a concrete form decking assembly to pour the concrete floor for bridges, high-rise buildings and the like, in which the spacing of the floor of the form decking assembly relative to the floor beams of the bridge or building can be adjusted from above after the floor of the form decking assembly has been put in place.

It is an object of the invention to provide a support assembly for supporting a concrete form assembly for pouring concrete in which a retaining wall of the form assembly is secured in place by elongated threaded bolts and in which a flange nut can be held against rotation for adjusting the spacing of said retaining wall by rotation of said threaded bolt and in which said flange nut can be released for rotation on said bolt to disassemble said concrete form assembly.

It is an object of the invention to provide a support assembly for supporting a concrete form assembly for pouring concrete in which a retaining wall of the form assembly is secured in place by elongated threaded bolts having a fixed nut rigidly secured at one end and a rotatable nut threaded thereon at its other end, in which a lock washer having bendable fingers is provided for bending one finger against the rotatable nut and another finger against an anchor member to prevent rotation of said rotatable nut on said bolt when so locked in place.

DESCRIPTION OF PREFERRED EMBODIMENT

Figure 1:
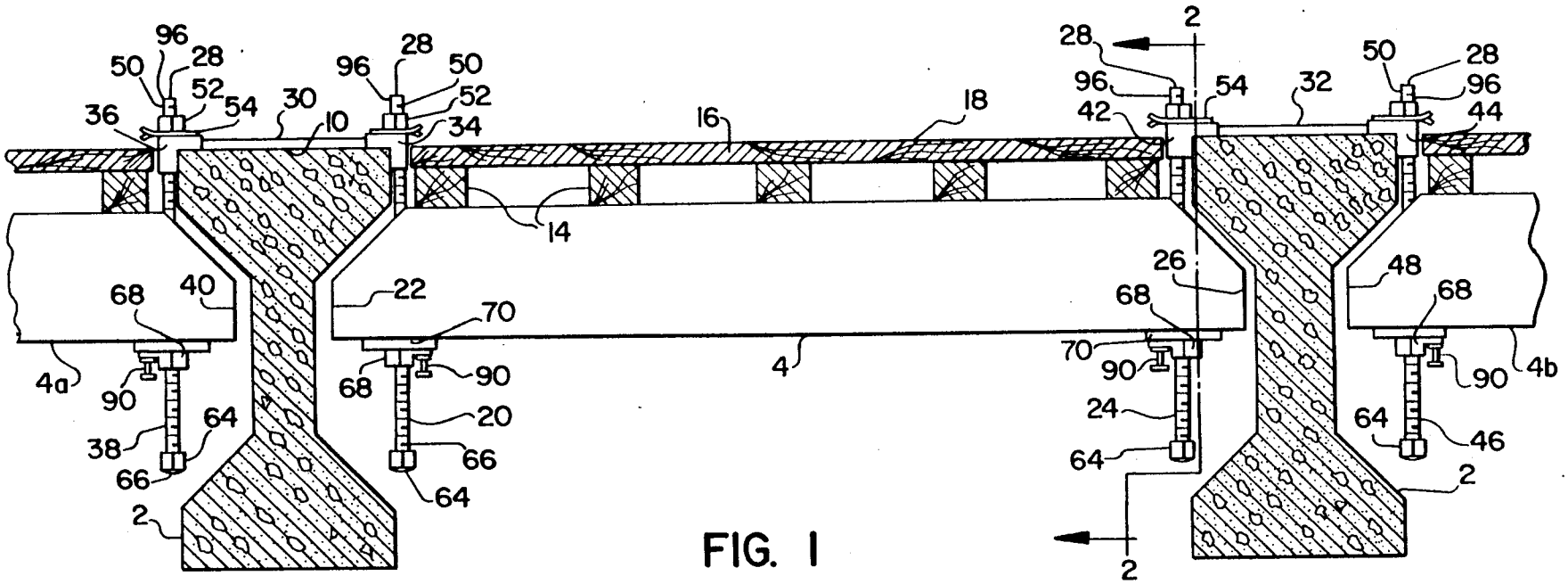
FIG. 1 is an elevation view of a support assembly in accordance with this invention shown in place to support a concrete form structure in place on the beams of a bridge for pouring the concrete floor of the bridge, the bridge beams and form structure shown partly in section.
Figure 2:
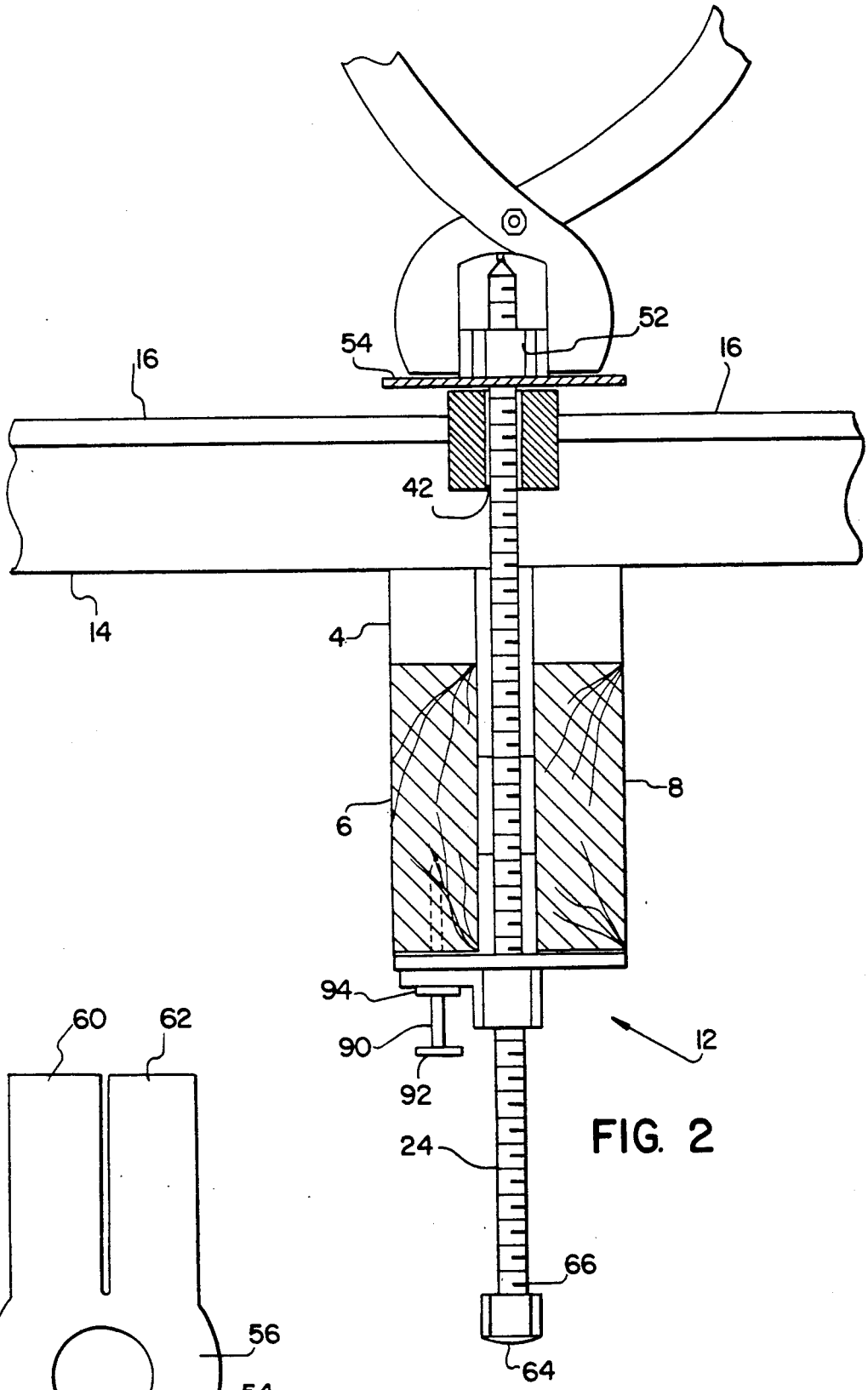
FIG. 2 is a section view taken on line 2—2 of FIG. 1 and enlarged.
Figure 3:
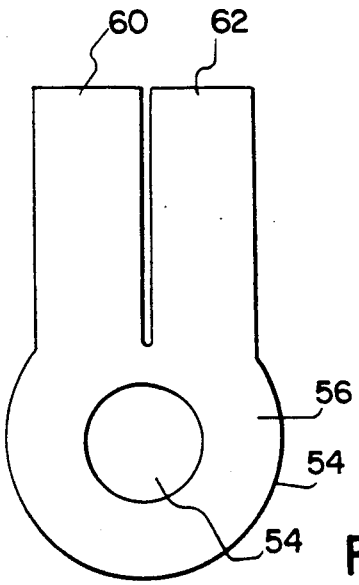
FIG. 3 is a plan view of a multi-finger lock washer for use in accordance with this invention.
Figure 4:
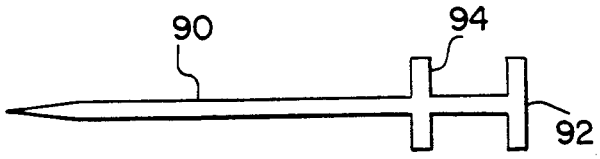
FIG. 4 is an elevation view of a nail having a depth limiting rib for use in accordance with this invention.
Figure 5:
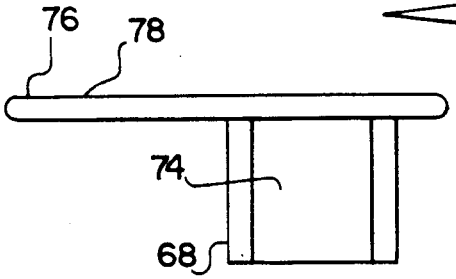
FIG. 5 is an elevation view of a flange nut for use in accordance with this invention.
Figure 6:
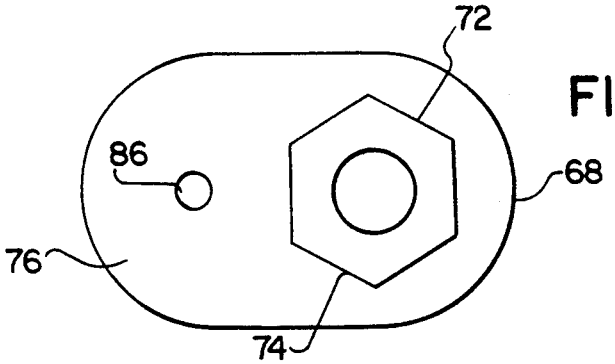
FIG. 6 is a plan view of the flange nut of FIG. 5.
Figure 7:
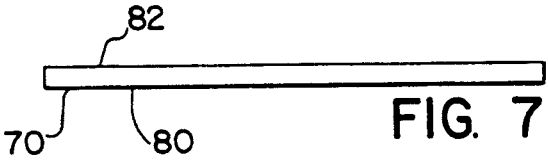
FIG. 7 is an elevation view of a support plate for use in accordance with this invention.
Figure 8:
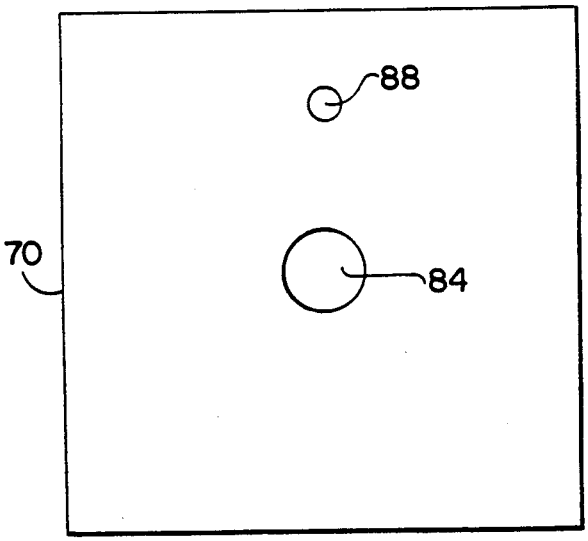
FIG. 8 is a plan view of the support plate of FIG. 7.
Figure 9:
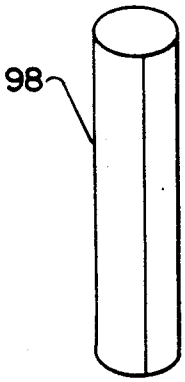
FIG. 9 is a perspective view of a plastic sheath to cover the exposed upper ends of the support bolts used in accordance with this invention prior to pouring the concrete floor.

An improved form support assembly in accordance with this invention is provided for supporting concrete form decking to lay the concrete floor for bridges and other structures.

A typical bridge structure under construction has steel or concrete bridge beams 2 which extend lengthwise or longitudinally in the direction of the roadway it serves supported above the span crossed by the bridge by vertically extending bridge support members. The longitudinal bridge beams 2 are spaced apart an appropriate distance such as six feet.

The typical concrete form decking on which concrete is to be poured to form the floor of the bridge that will be supported by the longitudinal bridge beams 2 includes laterally extending pairs 4 of wood planks 6 and 8, such pairs of planks usually called ledgers, extending between adjacent pairs of longitudinal bridge beams 2 and suspended downwardly from the upper surface 10 of such beams 2 a predetermined distance by the form support assembly 12 in accordance with this invention.

The typical dimensions of the wood planks 6 and 8 used for this purpose are two inch by ten inch, and the pairs of such planks or ledgers 4 are typically spaced apart from the next adjacent ledger 4 about four feet.

A plurality of stringers 14, each comprising an elongated length of wood of usually four inch by four inch cross-section, are next placed in the lengthwise or longitudinal direction to lay on top of the spaced apart laterally extending ledgers 4. The stringers 14 are typically spaced apart about sixteen inches.

On top of the stringers 14, three-quarter inch sheets of plywood 16 are laid to complete the concrete form decking structure on which the concrete is to be poured. After the concrete has been poured and allowed to set or cure, the concrete form decking structure comprising the ledgers 4, stringers 14 and plywood sheets 16 ar removed leaving the cured concrete floor of the bridge supported on the lengthwise bridge beams 2.

It is important that the upwardly facing surface 18 of the plywood sheet flooring be spaced vertically relative to the upper surface 10 of the bridge beams 2 a predetermined distance and a uniformly predetermined distance throughout to insure that when the concrete is poured its depth can be controlled to the exact thickness prescribed by the contract specifications and that such thickness will be maintained uniformly throughout the entire extent of the concrete floor.

In order to insure that the plywood flooring is maintained at the desired vertical level relative to the upper surface of the bridge beams 2, it is necessary from time to time to adjust the support assembly which holds the form decking structure in place on the bridge beams. Once the plywood sheets 16 are in place over the stringers 14, workmen can no longer reach through from above to get at the threaded nuts at the bottom of the support assembly under the ledgers 4 to rotate and thereby adjust the vertical level of the plywood flooring. The present invention makes it possible to accomplish such adjustment from above after the plywood flooring 16 has been put in place on the stringers 14.

The form support assembly 12 to support the concrete form decking structure on the bridge beams 2 in accordance with this invention includes a first vertically extending elongated bolt 20, about eighteen inches to two feet in length and about half-inch in diameter, to support one end 22 of a first ledger 4, and a second vertically extending elongated bolt 24 of the same length and diameter as bolt 22 to support the opposite end 26 of the ledger 4.

The bolts 20 and 24 are themselves supported at their upper ends 28 by respective hanger bars 30 and 32 which lay across the upper surfaces 10 of respective ones of a pair of adjacent spaced apart bridge beams 2. One end of hanger bar 30 has a receiving channel 34 to receive the upper end of elongated bolt 20 therethrough to extend downwardly along one side of the bridge beam 2, and the opposite end of hanger bar 30 has a receiving channel 36 to receive the upper end of a third elongated bolt 38. The third elongated bolt extends downwardly on the opposite side of the bridge beam 2 to support one end 40 of a second ledger 4(*a*) (shown as a fragment with its opposite end region broken away).

One end of hanger bar 32 has a receiving channel 42 to receive the upper end of elongated bolt 24 therethrough to extend downwardly along one side of the other bridge beam 2 of the said pair of adjacent spaced apart bridge beams. The opposite end of hanger bar 32 has a receiving channel 44 to receive the upper end of a fourth elongated bolt 46. The fourth elongated bolt extends downwardly on the opposite side of this bridge beam 2 to support one end 48 of a third ledger 4(*b*) (shown as a fragment with its opposite end region broken away).

The elongated bolts 20, 24, 38 and 46 and the plurality of others used to support the concrete form decking structure on the bridge beams 2 are threaded throughout, and typically have about 6 threads to the inch. The upper ends 50 of said bolts extend upwardly from the receiving channels of the hanger bars a sufficient distance to receive nuts 52 threaded thereon and respective rabbit ear lock washers 54 between the respective nuts 52 and receiving channels of the respective hanger bars.

The rabbit ear lock washers 54 comprise an enlarged peripheral ring portion 56 surrounding an aperture 58 to receive one of the said elongated bolts therethrough and a pair of fingers 60 and 62 projecting radially outwardly from the enlarged ring portion. The lock washers 54 are made of a bendable material, such as a relatively thin piece of aluminum, whereby one of the fingers 60 can be bent upwardly to bear against a side of the adjacent nut 52 and the other finger 62 can be bent downwardly to bear against a side of the adjacent receiving channel, such as 34, of the respective hanger bar, such as 30. The lock washers 54 are thus able to hold the nuts 5 from rotation relative to the receiving channels of the hanger bars as the elongated bolts themselves are rotated when it is desired to remove the bolts from the nuts after the concrete floor has been laid and the form structure is to be removed. They also hold the nuts 52 in place on the upper end 50 of the elongated bolts while adjusting the floor surface 18 to obtain the proper and uniform depth, laying the reinforcing bars in place and while pouring the concrete.

The elongated bolts, such as 20 and 24, have a fixed nut 64 welded or otherwise rigidly secured to their opposite lower ends 66, whereby the bolts can be rotated by applying a wrench to the fixed nuts 64 and rotating them.

Each of the said elongated bolts in accordance with this invention has a flange nut 68 rotatably threaded thereon between the upper end 28 and lower end 66, and a support plate 70 between the flange nut 68 and the upper end 28 slidably mounted on each of the said elongated bolts.

The flange nut 68 comprises a body portion 72 having an internally threaded bore to receive the threaded elongate bolts, such as 20 and 24, and a preferably hexagonal peripheral wall 74, and a flange portion 76 integrally formed with or affixed to the body portion 72 at the upwardly facing end of the flange nut 68 which faces toward the upper end 28 of the elongated bolt, such as 20, when threaded thereon. The flange portion 76 extends radially outwardly from the body portion 72 and internally threaded bore and has an upwardly facing planar surface 78 which faces the corresponding downwardly facing planar surface 80 of the support plate 70.

The support plate 70 also includes an upwardly facing planar surface 82 to bear against and support the planks 6 and 8 which make up the pair of planks that comprise each ledger 4. The support plate 70 has a central aperture 84, and its planar surface extends outwardly from each side of aperture 84 a distance at least equal to the width of a one of the planks 6 or 8 which comprise the pair making up each ledger 4. The aperture 84 is slightly larger than the diameter of the elongated bolts, such as 20 and 24 so as to enable support plate 70 to slide freely thereon, but smaller than the cross-sectional dimension of the upwardly facing planar surface 78 of the flange nut 68. Thus, as the threaded flange nut 68 rotates relative to the externally threaded bolt, such as bolt 20, in the direction which moves the flange nut 68 upwardly toward the upper end 50 of bolt 20, the planar surface 78 of flange nut 68 bears against the downwardly facing planar surface 80 of the support plate 70 forcing it upwardly also and the portion of ledger 4 resting on the upwardly facing planar surface 82 thereof.

To move the flange nut 68 and support plates 70 upwardly together with the ledgers 4 thereon, it is the elongated bolts, such as 20 and 24, which are rotated while the flange nuts 68 are held from rotation. To accomplish this, a nail receiving aperture 86 is provided through the flange portion 76 of the flange nut 68 offset from its central bore, and a corresponding nail receiving aperture 88 is also provided through support plate 70 offset from its central aperture 84 a distance to place it in registration with nail receiving aperture 86 of flange nut 68. Such apertures 86 and 88 are also located to be centered on the midline of one of the planks 6 or 8 which comprise the ledgers 4 when received on the support plate 70. A nail 90, having an outer nail head 92 and an inwardly spaced apart depth limiting annular rib 94, is then placed through the aligned nail apertures 86 of the flange nut 68 and 88 of the support plate 70, and driven into the plank 6 or 8 of ledger 4 resting thereon above said apertures. The nail 90 then holds flange nut 68 from rotation when the elongated bolts such as bolt 20, is rotated in one direction to raise flange nut 68, support plate 70 and ledger 4 thereon and in the opposite direction to lower the same.

The form support assembly 12 as described above is thus able to raise or lower the ledgers 4, stringers 4 and plywood sheets 16 of the concrete form decking structure, to adjust the height of the upwardly facing surface 18 of the plywood floor relative to the upper surface 10 of the bridge beams 2, by rotating the elongated bolts, such as 20, which can be done from above the plywood floor surface 18.

The nuts 52 are screwed on to the upper ends 50 of the elongated bolts far enough for an end portion 96 of the bolts to extend upwardly beyond the nuts 52 a quarter to a half inch or as desired. A clamp wrench may then be used to clamp a portion of both the extending end portion 96 of the bolt, such as 20, and the nut 52 and using such wrench to rotate both the nut 52 and bolt 20 together so that neither changes its relative position to the other. Such rotation of the bolts 20, with flange nut 68 held against rotation by the nail 90 embedded in one of the planks of ledger 4, causes the plywood floor surface 18 to be raised or lowered as desired to place it the desired distance even with or below the upper surface 10 of the bridge beams 2 and to make such distance uniform throughout the entire span of the bridge.

Each of the elongated bolts, such as 20, and the nuts 52 at their upper ends, which support all of the ledgers, stringers and plywood flooring of the form structure, can be rotated in the same way from above the surface 18 of the plywood flooring of the form, to obtain precise depth measurement for pouring concrete to the exact depth called for in the specifications and at such precise depth uniformly throughout the entire span of the bridge.

The form support assembly 12 in accordance with this invention also makes it possible to remove the concrete form decking structure safely after the concrete floor of the bridge has been poured and allowed to harden and cure. The nails 90 can be easily withdrawn from the ledger planks in which they were embedded. The nail heads 92 are spaced outwardly for readily grasping by a claw tool since the depth limiting annular ribs 94 of the nails 90 limit the depth to which the nails can be driven into the ledger planks. The nails 90 are thus withdrawn, whereupon the hexagonal shaped wall 74 of body portion 7 of the flange nuts 68 can be gripped by an ordinary end wrench and rotated on the threaded bolts, such as 20, in the direction which lowers flange nuts 68, support plates 70, ledgers 4 and the entire form structure. This separates the stringers 14 from bearing contact with the plywood sheets 16, which can then be stripped from the now hardened concrete to fall on to the stringers 14. The plywood sheets can then be safely lowered one by one, as can each of the stringers 14 in turn, and after that each of the ledgers 4.

All the while the form support assembly 12 remains in place to keep the form decking structure from accidentally falling to the ground below where it can and has caused serious injury when prior art support apparatus and equipment have been used.

After all of the plywood sheets, stringers and ledgers have been safely removed, the elongated bolts such as 20 are then removed by using a socket wrench or other appropriate tool to grasp the fixed nuts 64 at the lower ends 66 and rotating the elongated bolts in the direction which withdraws them from the nuts 52 threaded on their opposite upper ends 50. The upper ends 50 and nuts 52 are by this time embedded in the hardened concrete. The nuts 52 are held fast against rotation by the hardened concrete as well as by the lock washers 54, and they remain embedded in the concrete. To facilitate rotation of the bolts, such as 20, for removal after the concrete has hardened, a plastic sheath 98 can be provided to cover the extending end portion 96 of the bolts which extends upwardly from the nuts 52 prior to pouring the concrete. The sheaths 98 prevent the concrete from gripping the threads of the end portions 96 and holding them fast when the concrete hardens.

I claim:

1. A support assembly for concrete form structure used to pour concrete for the floor of a bridge or building, wherein such bridge or building includes longitudinally extending spaced apart floor beams and said concrete form structure includes a plurality of laterally extending spaced apart form members positioned between said spaced apart floor beams to support a solid form floor above said laterally extending form members and between said spaced apart floor beams, said laterally extending form members having a first end region and a second end region opposite from said first end region, said spaced apart floor beams having a substantially planar upper surface, said support assembly comprising a first elongated member for supporting said first end region of a one of said laterally extending form members, a second elongated member for supporting said second end region of said one of said laterally extending form members, first upper securing means to adjustably secure said first elongated member to a one of said floor beams, second upper securing means to adjustably secure said second elongated member to an adjacent one of said spaced apart floor beams, first lower securing means to releasably and adjustably secure said first elongated member to said one of said laterally extending form members at said first end region thereof, second lower securing means to releasably and adjustably secure said second elongated member to said one of said laterally extending form members at said second end region thereof, first adjusting means connected to said first elongated member to raise and lower said first end region of said one of said laterally extending form members relative to said upper surface of said floor beam to which said first elongated member is adjustably secured, second adjusting means connected to said second elongated member to raise and lower said second end region of said one of said laterally extending form members relative to said upper surface of said floor beam to which said second elongated member is adjustably secured, said first and second adjusting means including respective first and second adjustment operating means positioned above said solid form floor of said concrete form structure when said floor is in place above said plurality of laterally extending spaced apart form members, wherein said first and second elongated members comprise respective first and second externally threaded bolts, wherein said first upper securing means includes a first hanger bar across said upper surface of said one of said floor beams, a through channel at one end of said first hanger bar to receive a portion of said first externally threaded bolt therethrough, and a first internally threaded nut on said first externally threaded bolt above said through channel of said first hanger bar, said first adjustment operating means comprising means to rotate said first internally threaded nut and said first externally threaded bolt together without rotation of one relative to the other, wherein said second upper securing means includes a second hanger bar across said adjacent one of said spaced apart floor beams, a through channel at one end of said second hanger bar to receive a portion of said second externally threaded bolt therethrough, a second internally threaded nut on said second externally threaded bolt above said through channel of said second hanger bar, said second adjustment operating means comprising means to rotate said second internally threaded nut and said second externally threaded bolt together without rotation of one relative to the other, wherein said laterally extending spaced apart form members each comprise a pair of laterally extending planks having a laterally extending space therebetween to comprise a ledger, said first externally threaded bolt extending through said laterally extending space between said planks of said ledger at said first end region thereof, said second externally threaded bolt extending through said laterally extending space between said planks of said ledger at said second end region thereof, a first support plate received on said first externally threaded bolt below said ledger to bear thereagainst and support said first end region thereof, a second support plate received on said second externally threaded bolt below said ledger to bear thereagainst and support said second end region thereof, said first lower securing means comprising a first internally threaded flange nut threaded on said first externally threaded bolt below said first support plate, said first flange nut having a first flange extending radially outward, said first flange and said first support plate having respective nail apertures in registration with each other and with a one of said planks of said ledger supported by and above said first support plate, a first nail through said nail apertures of said first flange and said first support plate and into said one of said planks of said ledger to hold said first flange nut from rotation as said first externally threaded bolt is rotated by said first adjustment operating means above said solid form floor of said concrete form structure, said second lower securing means comprising a second internally threaded flange nut threaded on said second externally threaded bolt below said second support plate, said second flange nut having a second flange extending radially outward, said second flange and said second support plate having respective nail apertures in registration with each other and with a one of said planks of said ledger supported by and above said second support plate, a second nail through said nail apertures of said second flange and said second support plate and into said one of said planks of said ledger to hold said second flange nut from rotation as said second externally threaded bolt is rotated by said second adjustment operating means above said solid form floor of said concrete form structure.

2. A support assembly for concrete form structure as set forth in claim 1, wherein said first and second nails each include a nail head at their outer ends for grasping by a claw tool to remove said nails from said ledger and from said nail apertures, and each include an annular rib spaced apart inwardly from said nail head to limit the depth said nails can be driven into said ledger and to leave said nail head of each nail spaced apart outwardly for ready access by a said claw tool when they are to be removed.

3. A support assembly for concrete form structure as set forth in claim 1, wherein said first externally threaded bolt terminates below said concrete form structure in a lower end, a first fixed nut integrally secured to said lower end of said first externally threaded bolt, said second externally threaded bolt terminates below said concrete form structure in a lower end, a second fixed nut integrally secured to said lower end of said second externally threaded bolt.

4. A support assembly for concrete form structure used to pour concrete for the floor of a bridge or building, wherein such bridge or building includes longitudinally extending spaced apart floor beams and said concrete form structure includes a plurality of laterally extending spaced apart form members positioned between said spaced apart floor beams to support a solid form floor above said laterally extending form members and between said spaced apart floor beams, said laterally extending form members having a first end region and a second end region opposite from said first end region, said spaced apart floor beams having a substantially planar upper surface, said support assembly comprising a first elongated member for supporting said first end region of a one of said laterally extending form members, a second elongated member for supporting said second end region of said one of said laterally extending form members, first upper securing means to adjustably secure said first elongated member to a one of said floor beams, second upper securing means to adjustably secure said second elongated member to an adjacent one of said spaced apart floor beams, first lower securing means to releasably and adjustably secure said first elongated member to said one of said laterally extending form members at said first end region thereof, second lower securing means to releasably and adjustably secure said second elongated member to said one of said laterally extending form members at said second end region thereof, first adjusting means comprising said first elongated member to raise and lower said first end region of said one of said laterally extending form members relative to said upper surface of said floor beam to which said first elongated member is adjustably secured, second adjusting means comprising said second elongated member to raise and lower said second end region of said one of said laterally extending form members relative to said upper surface of said floor beam to which said second elongated member is adjustably secured, said first and second adjusting means including respective first and second adjustment operating means positioned above said solid form floor of said concrete form structure when said floor is in place above said plurality of laterally extending spaced apart form members, wherein said first and second elongated members comprise respective first and second externally threaded bolts, wherein said first upper securing means includes a first hanger bar across said upper surface of said one of said floor beams, a through channel at one end of said first hanger bar to receive a portion of said first externally threaded bolt therethrough, and a first internally threaded nut on said first externally threaded bolt above said through channel of said first hanger bar, said first adjustment operating means comprising means to rotate said first internally threaded nut and said first externally threaded bolt together without rotation of one relative to the other, wherein said second upper securing means includes a second hanger bar across said adjacent one of said spaced apart floor beams, a through channel at one end of said second hanger bar to receive a portion of said second externally threaded bolt therethrough, and a second internally threaded nut on said second externally threaded bolt above said through channel of said second hanger bar, said second adjustment operating means comprising means to rotate said second internally threaded nut and said second externally threaded bolt together without rotation of one relative to the other, wherein said laterally extending spaced apart form members each comprise a pair of laterally extending planks having a laterally extending space therebetween to comprise a ledger, said first externally threaded bolt extending through said laterally extending space between said planks of said ledger at said first end region thereof, said second externally threaded bolt extending through said laterally extending space between said planks of said ledger at said second end region thereof, a first support plate received on said first externally threaded bolt below said ledger to bear thereagainst and support said first end region thereof, a second support plate received on said second externally threaded bolt below said ledger to bear thereagainst and support said second end region thereof, said first lower securing means comprising a first internally threaded flange nut threaded on said first externally threaded bolt below said first support plate, said first flange nut having a first flange extending radially outward, said first flange and said first support plate having respective nail apertures in registration with each other and with a one of said planks of said ledger supported by and above said first support plate, a first nail through said nail apertures of said first flange and said first support plate and into said one of said planks of said ledger to hold said first flange nut from rotation as said first externally threaded bolt is rotated by said first adjustment operating means above said solid form floor of said concrete form structure, said second lower securing means comprising a second internally threaded flange nut threaded on said second externally threaded bolt below said second support plate, said second flange nut having a second flange extending radially outward, said second flange and said second support plate having respective nail apertures in registration with each other and with a one of said planks of said ledger supported by and above said second support plate, a second nail through said nail apertures of said second flange and said second support plate and into said one of said planks of said ledger to hold said second flange nut from rotation as said second externally threaded bolt is rotated by said second adjustment operating means above said solid form floor of said concrete form structure, said first adjusting means comprising said first externally threaded bolt, said through channel at one end of said first hanger bar, said first internally threaded nut on said first externally threaded bolt above said through channel of said first hanger bar, said first support plate received on said first externally threaded bolt below said ledger to support said first end region thereof, said first internally threaded flange nut threaded on said first externally threaded bolt below said first support plate, and said first nail through said nail apertures of said first flange of said first flange nut and of said first support plate and into one of said planks of said ledger to hold said first flange nut from rotation as said first externally threaded bolt is rotated by said first adjustment operating means above said solid form floor of said concrete form structure.

5. A support assembly for concrete form structure used to pour concrete for the floor of a bridge or building, wherein such bridge or building includes longitudinally extending spaced apart floor beams and said concrete form structure includes a plurality of laterally extending spaced apart form members positioned between said spaced apart floor beams to support a solid form floor above said laterally extending form members and between said spaced apart floor beams, said laterally extending form members having a first end region and a second end region opposite from said first end region, said spaced part floor beams having a substantially planar upper surface, said support assembly comprising a first elongated member for supporting said first end region of a one of said laterally extending form members, a second elongated member for supporting said second end region of said one of said laterally extending form members, first upper securing means to adjustably secure said first elongated member to a one of said floor beams, second upper securing means to adjustably secure said second elongated member to an adjacent one of said spaced apart floor beams, first lower securing means to releasably and adjustably secure said first elongated member to said one of said laterally extending form members at said first end region thereof, second lower securing means to releasably and adjustably secure said second elongated member to said one of said laterally extending form members at said second end region thereof, first adjusting means comprising said first elongated member to raise and lower said first end region of said one of said laterally extending form members relative to said upper surface of said floor beam to which said first elongated member is adjustably secured, second adjusting means comprising said second elongated member to raise and lower said second end region of said one of said laterally extending form members relative to said upper surface of said floor beam to which said second elongated member is adjustably secured, said first and second adjusting means including respective first and second adjustment operating means positioned above said solid form floor of said concrete form structure when said floor is in place above said plurality of laterally extending spaced apart form members, wherein said first and second elongated members comprise respective first and second externally threaded bolts, wherein said first upper securing means includes a first hanger bar across said upper surface of said one of said floor beams, a through channel at one end of said first hanger bar to receive a portion of said first externally threaded bolt therethrough, and a first internally threaded nut on said first externally threaded bolt above said through channel of said first hanger bar, said first adjustment operating means comprising means to rotate said first internally threaded nut and said first externally threaded bolt together without rotation of one relative to the other, wherein said second upper securing means includes a second hanger bar across said adjacent one of said spaced apart floor beams, a through channel at one end of said second hanger bar to receive a portion of said second externally threaded bolt therethrough, and a second internally threaded nut on said second externally threaded bolt above said through channel of said second hanger bar, said second adjustment operating means comprising means to rotate said second internally threaded nut and said second externally threaded bolt together without rotation of one relative to the other, wherein said laterally extending spaced apart form members each comprise a pair of laterally extending planks having a laterally extending space therebetween to comprise a ledger, said first externally threaded bolt extending through said laterally extending space between said planks of said ledger at said first end region thereof, said second externally threaded bolt extending through said laterally extending space between said planks of said ledger at said second end region thereof, a first support plate received on said first externally threaded bolt below said ledger to bear thereagainst and support said first end region thereof, a second support plate received on said second externally threaded bolt below said ledger to bear thereagainst and support said second end region thereof, said first lower securing means comprising a first internally threaded flange nut threaded on said first externally threaded bolt below said first support plate, said first flange nut having a first flange extending radially outward, said first flange and said first support plate having respective nail apertures in registration with each other and with a one of said planks of said ledger supported by and above said first support plate, a first nail through said nail apertures of said first flange and said first support plate and into said one of said planks of said ledger to hold said first flange nut from rotation as said first externally threaded bolt is rotated by said first adjustment operating means above said solid form floor of said concrete form structure, said second lower securing means comprising a second internally threaded flange nut threaded on said second externally threaded bolt below said second support plate, said second flange nut having a second flange extending radially outward, said second flange and said second support plate having respective nail apertures in registration with each other and with a one of said planks of said ledger supported by and above said second support plate, a second nail through said nail apertures of said second flange and said second support plate and into said one of said planks of said ledger to hold said second flange nut from rotation as said second externally threaded bolt is rotated by said second adjustment operating means above said solid form floor of said concrete form structure, wherein said first adjusting means connected to said first elongated member to raise and lower said first end region of said one of said laterally extending form members relative to said upper surface of said floor beam to which said first elongated member is adjustably secured includes said first externally threaded bolt, said through channel at one end of said first hanger bar, said first internally threaded nut on said first externally threaded bolt above said through channel of said first hanger bar, said first support plate received on said first externally threaded bolt below said ledger to support said first end region thereof, said first internally threaded flange nut threaded on said first externally threaded bolt below said first support plate, and said first nail through said nail apertures of said first flange of said first flange nut and of said first support plate and into one of said planks of said ledger to hold said first flange nut from rotation as said first externally threaded bolt is rotated by said first adjustment operating means above said solid form floor of said concrete form structure, said second adjusting means comprising said second externally threaded bolt, said through channel at one end of said second hanger bar, said second internally threaded nut on said second externally threaded bolt above said through channel of said second hanger bar, said second support plate received on said second externally threaded bolt below said ledger to support said second end region thereof, said second internally threaded flange nut threaded on said second externally threaded bolt below said second support plate, and said second nail through said nail apertures of said second flange of said second flange nut and of said second support plate and into one of said planks of said ledger to hold said second flange nut from rotation as said second externally threaded bolt is rotated by said second adjustment operating means above said solid form floor of said concrete form structure.

* * * * *